US006170414B1

(12) United States Patent
Kaetterhenry et al.

(10) Patent No.: US 6,170,414 B1
(45) Date of Patent: Jan. 9, 2001

(54) QUILTING MACHINE WITH ADJUSTABLE PRESSER PLATE AND METHOD OF OPERATING THE QUILTING MACHINE

(75) Inventors: Jeff Kaetterhenry, Davie; Glenn Leavis, Hollywood; Michael James, Davie; James Bondanza, Sunrise, all of FL (US); Richard N. Codos, Warren, NJ (US)

(73) Assignee: L&P Property Management Company, South Gate, CA (US)

( * ) Notice: Under 35 U.S.C. 154(b), the term of this patent shall be extended for 0 days.

(21) Appl. No.: 09/517,239

(22) Filed: Mar. 2, 2000

Related U.S. Application Data

(63) Continuation-in-part of application No. 09/306,744, filed on May 7, 1999.

(51) Int. Cl.[7] ..... D05B 11/00

(52) U.S. Cl. ..... 112/117; 112/102.5; 112/475.19

(58) Field of Search ..... 112/117, 118, 112/119, 475.19, 475.01, 470.06, 102.5, 235, 163, 164, 165, 166, 167

(56) References Cited

U.S. PATENT DOCUMENTS

| | | |
|---|---|---|
| 1,948,876 | 2/1934 | Boettcher . |
| 2,540,987 | 2/1951 | McCann . |
| 2,560,334 | 7/1951 | Enos . |
| 2,576,357 | 11/1951 | Preston . |
| 3,147,720 | 9/1964 | Kuhn . |
| 3,385,246 | 5/1968 | Schlegel . |
| 3,410,238 | 11/1968 | Rolauffs . |
| 3,473,497 | 10/1969 | Cash . |
| 3,633,525 | 1/1972 | Landoni . |
| 4,006,696 | 2/1977 | Robertson . |
| 4,006,697 | 2/1977 | Robertson . |
| 4,060,045 | 11/1977 | Vahle et al. . |
| 4,089,281 | 5/1978 | Landoni . |
| 4,409,914 | 10/1983 | Sansone . |
| 4,454,830 | 6/1984 | Bennett . |
| 4,466,369 | 8/1984 | Dreier . |
| 4,508,043 | 4/1985 | Vollmar . |
| 4,550,671 | 11/1985 | Dusch . |
| 4,852,506 | 8/1989 | Salganik . |
| 5,001,997 | 3/1991 | Wang . |
| 5,042,406 | 8/1991 | Jimenez et al. . |
| 5,154,130 | 10/1992 | Gribetz et al. . |
| 5,355,816 | 10/1994 | Echevarria . |

(List continued on next page.)

*Primary Examiner*—Peter Nerbun
(74) *Attorney, Agent, or Firm*—Wood, Herron & Evans, L.L.P.

(57) ABSTRACT

A quilting apparatus is provided with a computer controlled presser plate adjusting mechanism. A presser plate rocker shaft is separate from and mechanically connected to a needle rocker shaft and imparts a reciprocating motion to the presser plate. The presser plate rocker shaft is adjustable to vary the range of its output link to the presser plate, thereby changing the endpoints of its reciprocating path of travel. Certain embodiments have an output end of the presser plate rocker shaft adjustable relative to the input end through a coupling to different angular positions relative to an input end in order to change the upper and lower ends of the range of reciprocation of the pressure plate relative to the needle plate. Alternatively, the length of a link between the needle and pressure plate rocker shafts is variable to make the presser plate adjustment. A motor or other actuator changes the coupling or link in response to a signal from a quilting machine controller, which can be made instantly, either manually by an operator at a controller interface terminal, by a batch mode program run by the controller to set the machine to the parameters required by products on a product schedule, or automatically in response to measurements from sensors that are interpreted by the controller in determining optimal pressure plate setting.

14 Claims, 10 Drawing Sheets

U.S. PATENT DOCUMENTS

| | | | | |
|---|---|---|---|---|
| 5,461,997 | | 10/1995 | Landen . | |
| 5,505,150 | * | 4/1996 | James et al. | 112/117 X |
| 5,509,365 | | 4/1996 | Cash . | |
| 5,590,614 | | 1/1997 | Murata et al. . | |
| 5,617,802 | | 4/1997 | Cash . | |
| 5,634,417 | | 6/1997 | Katou . | |
| 5,694,872 | | 12/1997 | Zeller . | |
| 5,960,730 | | 10/1999 | Picker . | |
| 5,967,068 | | 10/1999 | Landoni . | |

* cited by examiner

QUILTING MACHINE WITH ADJUSTABLE PRESSER PLATE AND METHOD OF OPERATING THE QUILTING MACHINE

This is a continuation-in-part of U.S. patent application Ser. No. 09/306,744, filed May 7, 1999, hereby expressly incorporated herein by reference.

FIELD OF THE INVENTION

This invention relates generally to the field of quilting machines and, more particularly, to an improved quilting machine for stitching quilts of different thicknesses.

BACKGROUND OF THE INVENTION

In the manufacture of quilted fabrics in which, for example, a cover, a liner and one or more layers of filling material are joined to form an article such as a quilted furniture cover or a mattress cover, automated quilting machinery is commonly employed to stitch the layers of material together, with stitching applied in repeated patterns, or arrays of repeated patterns. High speed and economic production of such quilted fabrics generally requires equipment utilizing arrays of needles, ganged together and driven through a common stitch forming mechanism, to apply a plurality of patterns simultaneously in a predetermined array.

In between each stitch of the needle, the layers of fabric are moved in unison with respect to the needles in order to place the next stitch at the desired point in the quilting pattern. Further, with each stitch cycle of the needles, a presser plate on one side of the multi-layered fabric is moved toward a needle plate on the other side of the fabric to compact the layers of material between the plates for the stitching process. As the needles move out of the material, the presser plate is simultaneously lifted or moved away from the needle plate, thereby permitting the material to be moved for the next stitch. Normally, the needles are mechanically coupled to and driven by a needle bar rocker shaft that, in turn, is mechanically connected to and driven by a continuously rotating drive shaft. The presser plate is also mechanically connected to and driven by the needle bar rocker shaft. The motion of the presser plate is thus mechanically and constantly fixed with respect to the motion of the needle.

With every stitch cycle, the presser plate usually starts a stitch cycle at the same uppermost position with respect to the needle plate, moves downward to the same lowermost position with respect to the needle plate and then retracts upward to the starting uppermost position. Thus, with each stitch, such a presser plate moves the same distance downward to the same material compaction position and then retracts the same distance to its uppermost starting position. Since the operation of the presser plate is mechanically fixed throughout the quilting process, the gap between the presser plate and the needle plate at any given point in the stitching cycle is always the same. Therefore, a quilting machine is practically limited to stitching layers of material that have the same thickness. The relative motion of the presser plate is controlled by cams on a rocker shaft. Therefore, it is possible to change those cams in order to provide a different gap between the presser plate and the needle plate during the stitching cycle. Even though reconfiguring the quilting machine is possible by changing various cams, the task requires many hours of complex and difficult labor and, therefore is rarely if ever done.

Therefore, as a practical matter, if one desires to stitch a thicker quilt, a different quilting machine is generally used which has been configured to have a generally larger gap between the presser plate and the needle plate throughout the stitching cycle. With a thicker quilt, the presser plate must have a higher starting position that allows the thicker quilt to be inserted thereunder and a higher, full compaction position that properly compresses the thicker quilt during the stitching process. The requirement that different quilting machines must be used to stitch quilts having different thicknesses presents significant disadvantages. For example, for quilt manufacturers who can afford only one quilting machine, their market is limited to those applications for quilts of the single thickness that can be readily produced on that one machine. In other situations, the commercial demand or quantity of a quilt of a particular thickness may be relatively small; and therefore, the purchase and maintenance of an automated quilting machine to make such a quilt cannot be economically justified. Thus, those markets must be served by quilts that have a higher labor content and thus, are more expensive.

When quilting materials such as mattress covers and borders on a multi-needle chainstitch-quilting machine, the height of the presser foot above the needle plate is critical to proper stitch formation, sewing reliability and product quality. The presser foot height is determined primarily by the thickness and density of the materials to be stitched.

Therefore, users currently adjust quilting machines to sew a specific thickness range, depending on expected production requirements. As a result, when it becomes necessary to sew a different thickness, the machine must be re-adjusted, usually by maintenance personnel in a procedure that involves significant amounts of time. Such personnel must know the proper height setting for any given combination of materials.

Consequently there in a need for an improved quilting machine that is more flexible in its operation and reconfiguration so that with an easy adjustment quilts of different thicknesses may be stitched.

SUMMARY OF THE INVENTION

An objective of the present invention is to provide a quilting machine and method that is flexible in its ability to produce quilts of different thicknesses. A particular objective of the invention is to provide for adjustment of presser foot position in quilting processes so as to allow a single quilting machine to accommodate materials of differing thicknesses.

Further objectives of the invention include providing the correct presser foot setting for quilted products, particularly where the products are made automatically, and particularly where product thicknesses might change from one product to the next. Additional objectives of the invention are to provide quick presser foot adjustment requiring little operator skill or experience, to reduce error in the making of presser foot adjustments, to provide reliable and repeatable presser foot adjustments, and to provide automatic presser foot adjustments. Particular objectives of the invention are to provide for automatically making presser foot settings appropriate for each particular quilted product without the intervention of an operator, including by automatically providing a setting that has been predetermined to be appropriate for the product and by providing a setting that is sensed by the machine to be appropriate for the product. Other objectives of the invention are to provide a mechanism for quickly changing presser foot settings that is durable, and to provide a mechanism by which the height of both the lower and upper presser foot positions and the distance between lower and upper presser foot positions can be increased with the thickness of the material.

The invention achieves various of its objectives by making adjustment of the presser foot height totally automatic for batch mode and automatic operation, with the optimum position of the pressure foot determined by the machine controller computer based on product database information, motor torque feedback, material or load sensors and other methods. For manual operation, adjustments can be made instantly with the simple touch of an icon.

In accordance with the principles of the present invention, a quilting machine and method are provided with an adjustable drive linkage to quickly change the presser foot setting. The drive linkage is adjusted by a motor or other actuator, which is in turn responsive to a control signal produced in response to a controller. The controller in turn responds either to an input signal from an operator or facility computer or to information in a product database of a batch control system. The presser foot linkage may operate to move end positions of the presser foot travel during each stitch cycle between two positions, among a plurality of more than two positions, or continuously between maximum and minimum settings. Preferably, the actuator is out of the line of the main drive to the presser foot or needle bar to minimize loads on the actuator and reduce failure rate of the drive train.

In the various preferred embodiments of the invention, presser foot settings are changeable by operator input, by rotating a knob or other control element or by selecting an icon on the touch screen of a controller and inputting data to change the setting. In other embodiments, a product data file contains pattern information and other parameters that define each of a plurality of products, with such parameters including the pressure foot setting appropriate for the thickness of the particular product. In further embodiments, sensors measure or otherwise respond to forces, torques power demands, compressed material dimensions or other parameters that change as a function material thickness or density.

In accordance with certain embodiments of the invention, there is provided an apparatus for stitching fabric to produce a quilted fabric. The apparatus has a needle plate for supporting the fabric, a presser plate located above the needle plate and a needle, or preferably one or more needle bars, each of which holds a plurality of needles. A needle rocker shaft is mechanically connected to the needle or needle bars and imparts reciprocating motion to the needles in response to the displacements, preferably angular displacements, of the needle rocker shaft. Further, a presser plate rocker shaft that is distinct from the needle rocker shaft is mechanically connected to the needle rocker shaft and imparts a reciprocating motion to the presser plate in response to the displacements, preferable angular displacements, of the presser plate rocker shaft. A presser plate adjusting mechanism controls the range and limits of motion of the presser plate rocker shaft so that the lowermost and uppermost points of travel of the presser plate can each be set to one of a plurality of positions to accommodate fabric of different thicknesses.

In certain embodiments of the invention, the presser foot is driven by a system that eliminates the cams and springs, replacing them with a separate rocker shaft and lever mechanism for the presser foot operation that is similar to the system used for the needles. A second, independent rocker shaft is provided to drive only the presser foot, while the rocker shaft commonly used for driving both the needles and the presser plate drives the needle bars. The presser foot rocker shaft is preferably driven by the needle rocker shaft through a lever and link mechanism. The presser foot rocker shaft drives a presser foot rod, which in turn moves the presser foot down and up with a lever and link mechanism. The height of the presser foot above the needle plate is adjusted by adjusting a coupling in the presser plate rocker shaft or by effectively changing the length of the presser foot rocker shaft drive link by adjusting the phase of presser plate rocker shaft.

In some embodiments of the invention, the presser plate rocker shaft has input and output shafts that are easily movable to different relative angular positions to locate the presser plate at a different positions with respect to the needle plate. First and second positions of the presser plate provide, for example, respective first and second gaps between the presser plate and the needle plate, which permit fabrics of different thicknesses to be quilted.

In one aspect of the invention, the presser plate rocker shaft includes a coupling for moving the input and output shafts of the presser plate rocker shaft to the different angular positions with respect to each other. Thus, the gap between the presser plate and the needle plate can be changed without changing the position of the needle.

One method of operating a quilting machine according to the invention includes setting the presser plate to a first position with respect to the needle plate, loading a first fabric having a first thickness, stitching the first fabric, setting the presser plate to a second position with respect to the needle plate without changing cams on the machine, loading a second fabric having a second thickness, and stitching the second fabric.

In further embodiments of the invention, a link is provided to maintain a fixed component of the angular position of the presser plate rocker shaft. A variable actuator is provided in the link to change the fixed component. The presser rocker shaft oscillates about the fixed component angular position so that changes in the actuator setting changes the upper and lower positions of the presser plate during its cycles. The actuator may be any of a number of different motors or devices, including, for example, a two position pneumatic cylinder, a series of two position cylinders or a pneumatic or electrical actuator having more than two positions, a stepping or servo motor, or a continuous drive motor that may be, for example, a rack and pinion drive or a worm gear, to name a few.

Where the controller signals the actuator in response to an operator actuated input control on a tough screen, to load or other sensors on the quilting machine, or to data in a product database, the data may contain product parameters of batch control systems such as, for example, those described in U.S. Pat. No. 5,544,599 or U.S. patent application Ser. No. 09/301,653, filed Sep. 23, 1999, hereby expressly incorporated by reference herein.

The present invention provides the advantages of a quilting machine and method substantially more flexible in operation than quilting machines and methods of the prior art. The present invention permits the quilting machine to be easily reconfigured so that different gaps can be easily set between a presser plate and a needle plate, so that fabric layers of different thicknesses can be stitched on the same machine. Thus, the invention permits one machine to serve a great many different markets for quilted fabrics. Further, small quantities of quilted fabrics of different thicknesses can be economically supplied with a single machine. The quilting machine of the present invention provides its user with opportunities to supply different quilted products in a way that was not possible in the past with a single quilting machine.

In particular, advantages of various embodiments of the invention include improved automation whereby operators and maintenance personnel are no longer required to do anything to adjust the presser foot height in batch mode or automatic operation. The invention provides simplicity. Manual adjustments can be made with simply the touch of an icon. No tools, levers or cranks are needed. Further, adjustments are virtually instantaneous. Labor intensive and time consuming mechanical adjustments are eliminated.

Consistency of pressure foot setting is also provided. In batch mode or automatic operation, for example, the presser foot will always be in the correct position, without depending on the operator to know when adjustments are needed or what the correct position is for any given combination of materials. Guesswork and sources of error are eliminated.

Reliability of machinery and machine components is provided. The automatic mechanisms are designed to function within pre-defined ranges. It is impossible to adjust the presser foot beyond acceptable limits to a point where damage to the equipment could result. Further, less knowledge is required of operators because they no longer need to be concerned with presser foot settings. Less skill is required of maintenance personnel because critical mechanical adjustments are eliminated.

These and other objects and advantages of the present invention will become more readily apparent during the following detailed description together with the drawings herein.

DETAILED DESCRIPTION OF THE INVENTION

Figure 1:
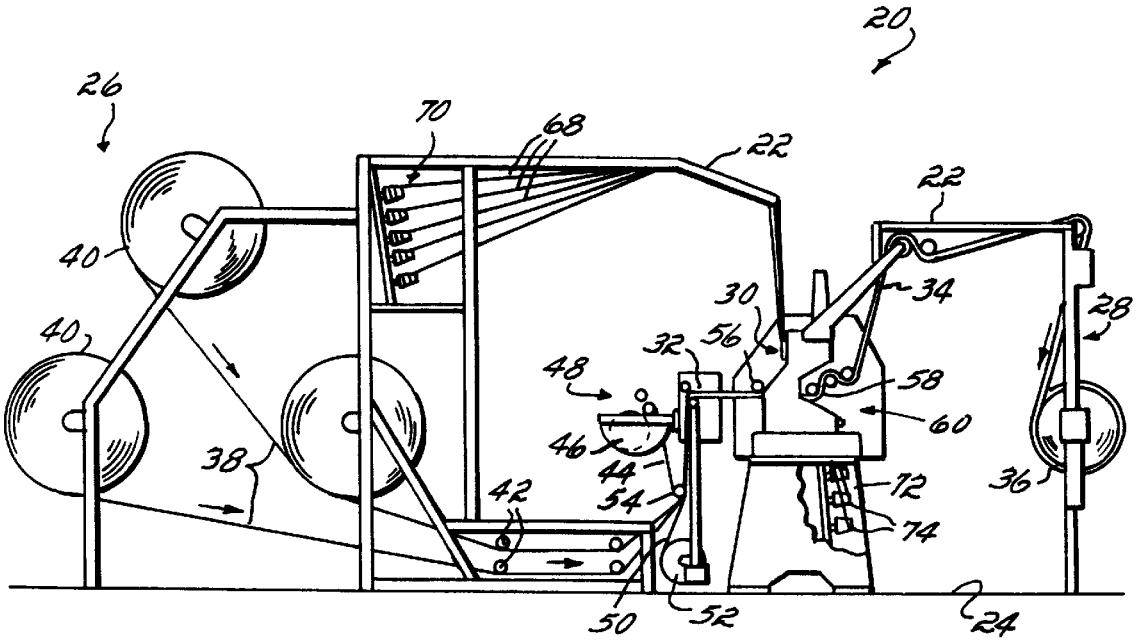
FIG. 1 is an elevation view of a quilting machine embodying the principles of the present invention.

Referring to FIG. 1, a double lock chain stitch quilting machine 20 according to one embodiment of the present invention is illustrated. The machine 20 includes a frame 22 assembled in one or more components on a plant floor 24. Assembled to the frame 22 is a fabric material supply station 26 at the upstream end of the frame 22, a quilt take-up station 28 at the downstream end of the frame 22, and a quilting station 30 between the supply station 26 and the take-up station 28.

At the quilting station 30, a stitch pattern is applied to a multiple layered fabric 32 to form a quilt 34, which then passes to the take-up station 28 where it is wound upon a take-up roll 36, which is rotatably supported on a transverse axle to the frame 22 at the take-up station 28. The fabric 32 is formed of one or more layers of filler material 38 from supply rolls 40 mounted on horizontal transverse axles to the frame 22 at the supply station 26. The filler material 38 is fed downstream from the supply station 26 around guide rollers 42 and between two layers of cover material, including an outer cover 44 from a supply roll 46 lying in a trough mounted to the frame 22 above the flights of filler material 38 at the entry end 48 of the quilting station 20, and a liner or backing 50 from a supply roll 52, rotatably mounted on a transverse axle to the frame 22 below the filler material 38 at the entry end 48 of the quilting station 30.

The layers of material 38, 44 and 50 are brought together at a roller station 54 at the entry end 48 of the quilting station 30, to form the fabric 32. The roller station 54 includes two pair of transversely extending, transversely shiftable, reversible feed rollers 56, 58. Rollers 56 are adjacent the entry end 48 of the quilting station 30 and receive the fabric 32 before it enters the quilting station 30. The entry feed rollers 56 are driven in synchronism with cooperating exit feed rollers 58 at the exit end 60 of the quilting station 30 rotating or transversely shifting together, to advance, reverse and transversely shift the fabric 32 as it moves through the quilting station 30.

At the quilting station 30, the fabric 32 is sewn, with a stitch forming mechanism into arrays 62 of a quilted pattern 64 (FIG. 2) from a plurality of needle threads 68, from a plurality of needle thread spools 70 mounted on the frame 22 near the supply station 26, and a plurality of looper threads 72, from a plurality of looper thread spools 74 mounted on the frame 22 beneath the quilting station 30.

In a known manner, the needle threads 70 pass through a bank of thread tension adjusters at the front side of the frame 22 at the quilting station, prior to passing to the quilting station 30. These adjusters are mechanically settable to provide proper thread tension. They are also controlled by pneumatic solenoid controlled actuators to switch between a tension state, at which the set tension is applied to the needle threads 70, and a release state, at which no tension or minimum tension is applied to the threads 70. Alternatively, separate thread clamps may be provided at a position along the thread close to the needles; however, their exact location is dependent on the elasticity of the thread, and is selected to avoid thread snap-back and unthreading of the needles. Other details of the quilting machine 20 illustrated in FIG.

1 are set forth in the commonly owned U.S. Pat. No. 5,154,130 which is hereby in its entirety incorporated by reference herein. Further, such machines are commercially available from Gribetz International of Sunrise, Fla.

Figure 2:
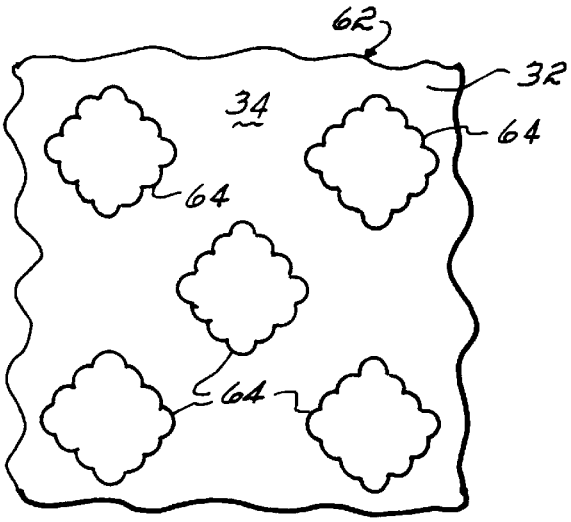
FIG. 2 is a plan view of the front side of a fabric quilted with an array of discrete 360° patterns quilted on the quilting machine of FIG. 1.
Figure 3:
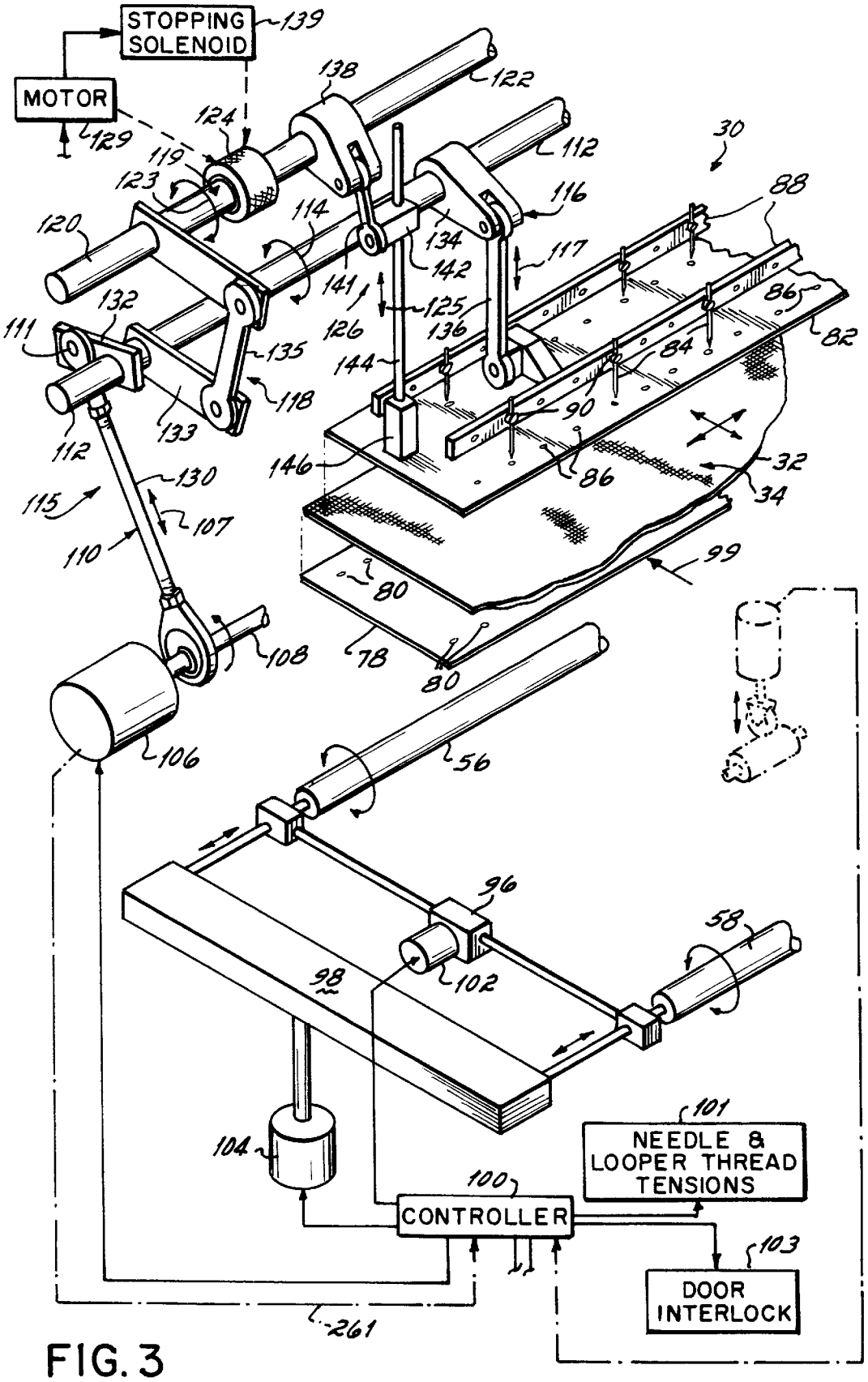
FIG. 3 is a diagrammatic disassembled perspective view of the presser foot operating and related components of one embodiment of the quilting machine of FIG. 1, illustrating the relationships of actuators and drives of the quilting station of the machine.
Figure 4:
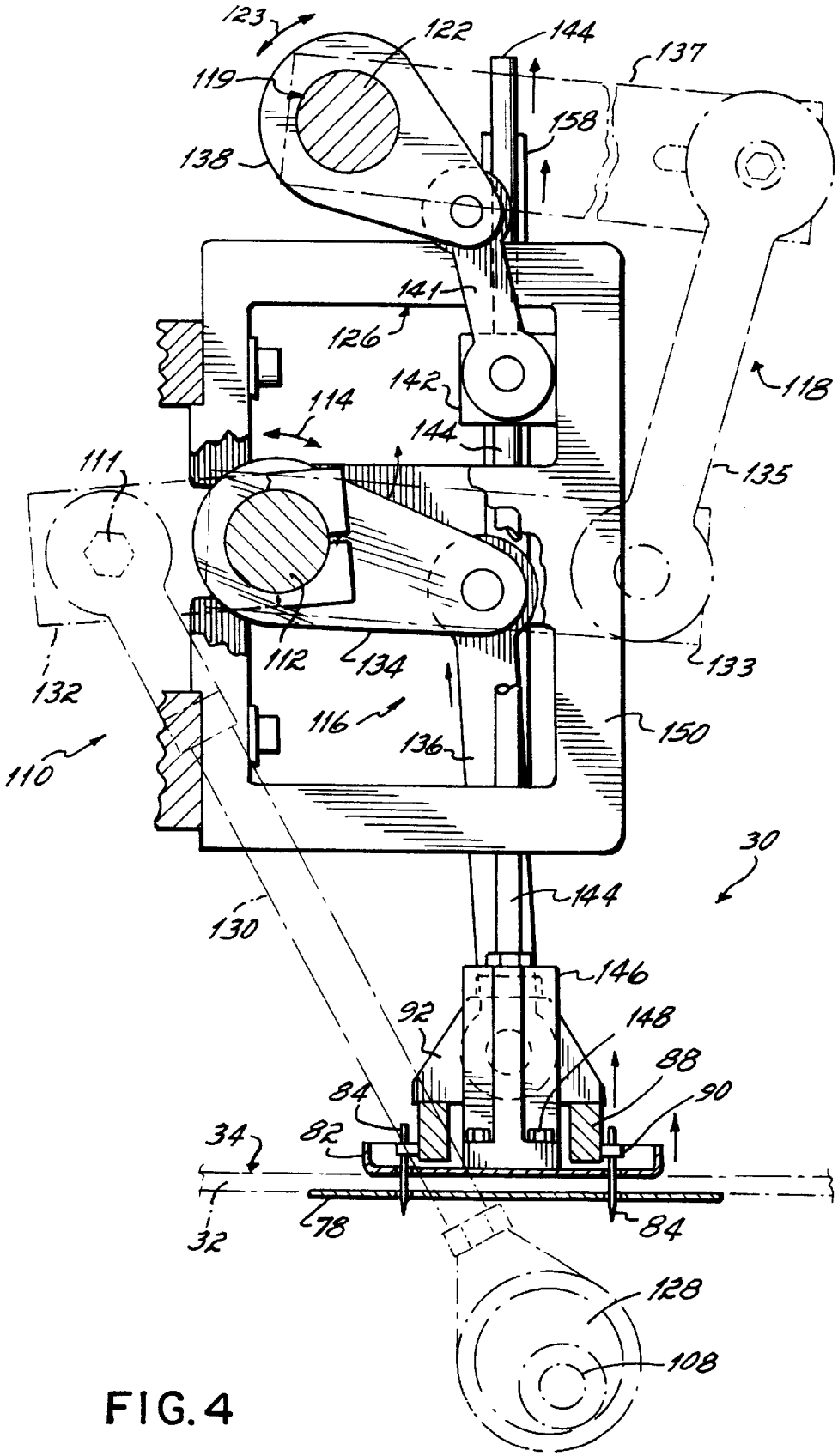
FIG. 4 is a cross-sectional end view of the quilting station embodiment of FIG. 3 illustrating the various interconnecting drives.

As illustrated in FIGS. 3 and 4, a needle plate 78 supports the fabric 32 as patterns, such as pattern 64 (FIG. 2), are stitched on it to form the quilt 34. The needle plate 78 has a matrix of needle receiving holes 80 spaced approximately one inch apart in parallel rows, spaced about six inches apart. A presser foot or plate 82, which is located above the needle plate 78, moves down to press the fabric 32 against the needle plate 78 to hold the fabric as needles 84 are extended through it, and the presser plate 82 moves up to allow the fabric 32 to be moved. The presser plate 82 also has a matrix of holes 86 which correspond to the matrix of needle holes 80 in the needle plate 78.

Positioned above the presser plate 82 is a set of parallel transversely oriented and longitudinally spaced needle support bars 88, each having a matrix of needle holders 90 thereon corresponding to, and spaced directly above, each of the holes 86, 80 in respective presser and needle plates 82, 78. Each of the holders 90 includes a vertical groove and a clamping screw positioned in a threaded hole beside the groove to clamp the needle securely in position. The needles 84 are mounted in an array on the needle bars 88 to define the relative spacings of patterns, such as pattern 64 in pattern array 62 (FIG. 2). The needle bars 88 are ganged through cross members 92, mounted to reciprocate vertically on the frame 22 at quilting station 30, to move up and down on the frame 22, as shown by the arrow 94, so that each of the needles 84 passes through corresponding holes 86, 80 in the respective presser and needle plates 82, 78.

The array 62 of discrete patterns, such as the pattern 64 of FIG. 2, is achieved by programmed motion of the fabric 32 transversely and longitudinally by motion of the feed rollers 56 and 58 moving in synchronism with the operation of the presser plate 82 and needle bars 88 to form stitches, preferably of equal length, in the pattern shape. The 360° patterns 64 of the array 62 are accomplished by forward and reverse rotation of the feed rollers 56 and 58 as well as transverse reciprocating motion of the rollers 56 and 58. The discrete character of the patterns 64 of FIG. 2 involves the formation of several tack stitches upon the completion of a pattern 64, a cutting of at least the top or needle threads 68, and a repositioning of the fabric 32 under the needles 84 for the beginning of the next pattern. The feed rollers 56 and 58 are driven in synchronism by the a feed roller movement mechanism that includes a roller reversible rotary drive 96, shown schematically in FIG. 3. The reversibility of the drive 96, and the ability to pull the fabric 32 from the front by rollers 58 as well as from the back by rollers 56, provides an ability to form 360° patterns such as pattern 64. During the stitching process, the fabric 32 feeds generally in the direction of the arrow 99.

The rollers 56 and 58 are also shiftable transversely, in synchronism with each other, by transverse roller drive 98. These roller drives 96 and 98 are electronically linked to the operation of the presser plate 82 and needle bars 88 by a controller 109. The rotary feed drive 96 is driven by feed motor 102 while the transverse drive 98 is driven by shift motor 104. The ratio and relative direction of the drives 96 and 98 and operation of the presser plate 82 and needle bars 88 is controlled in response to a computer, containing a pattern program, within the controller 100. The controller 100 permits the drives 96 and 98 and the motors 102 and 104 can be driven in synchronism with, or disengaged from, the presser plate 82 and needle bars 88, which are driven by a separate drive motor 106. Each of the motors 102, 104, 106 can be locked in position while the others are activated, under control of the controller 100. The controller 100 further controls needle and looper thread tensioners 101 and responds to the states of door interlocks 103 in a known manner.

An output shaft of the motor 106 is connected to a main drive shaft 108 that extends transversely to the fabric feed direction along the length of the quilting station 30. The main drive shaft 108 rotates continuously but by means of an eccentric coupling, imparts a linear oscillating motion to a mechanical linkage 110 that drives a needle bar and presser plate reciprocating assembly 115. The mechanical linkage 110 reciprocates as illustrated by arrow 107 to impart angular oscillations to the needle bar rocker shaft 112 as indicated by the arrow 114 and operate the needle bar and presser plate reciprocating assembly 115.

The angular displacement or amplitude of the angular oscillation is determined by the eccentric drive coupled to the main drive shaft 108 and the mechanical linkage 110 interconnecting the needle rocker shaft 112 with the main drive shaft 108. The needle rocker shaft 112 extends transversely to the fabric feed direction along the length of the quilting station 30. At selected locations, mechanical linkage 116 interconnects the needle bars 88 with the needle rocker shaft 112 and functions to convert the reciprocating angular oscillations of the needle bar rocker shaft 112 into a vertical reciprocating motion of the needle bars 88 as indicated by the arrow 117. The linear displacement or amplitude of the reciprocating motion of the needle bars 88 is a function of the magnitude of the oscillation of the needle bar rocker shaft 112 and the mechanical linkage 116.

Mechanical linkage 118 connects a presser plate rocker shaft 119 with the needle bar rocker shaft 112. The presser plate rocker shaft 119 is comprised of an assembly of a presser plate input rocker shaft 120, a presser plate output rocker shaft 122 and a static phase adjusting coupling 124 connected between the shafts 120, 122. The static phase adjusting coupling 124 provides angular adjustment between the input and output presser plate rocker shafts 120 and 122 and provides the presser plate adjustment which determines the spacing between the presser plate 82 and the needle plate 78 at the lowermost and uppermost positions of the presser plate 82 in each stitch cycle. With the coupling 124 set in any position, in the course of the stitching cycles, the presser plate rocker shaft 119 oscillates through an angular displacement represented by the arrow 123, and that displacement is temporally identical with the angular oscillations of the needle bar rocker shaft 112. The magnitude or angular displacement with each oscillation of the presser plate rocker shaft 119 is a function of the amplitude of the oscillation of the needle bar rocker shaft 112 and the mechanical linkage 118 interconnecting the shafts 112, 120. Mechanical linkage 126 interconnects the output presser plate rocker shaft 122 with the presser plate 82 and imparts a reciprocating vertical motion to the presser plate 82, as indicated by arrow 125, in response to the angular oscillations of the output presser plate rocker shaft 122. The linear displacement or amplitude of each reciprocation of the presser plate 82 is a function of the angular displacement of the oscillation of the output presser plate rocker shaft 122 and the mechanical linkage 126.

Thus, the operation of the drive motor 106 causes the presser plate 82 to move through a vertically linear reciprocating motion that is synchronized with a vertically linear reciprocating motion of the needle bars 88, thereby permitting the fabric 32 to be moved by the feed rollers 56, 68 and the drive 96 to desired different locations between each stitching cycle.

A manually operable version of the static phase adjusting coupling 124 is a 360° positioner commercially available from Candy Controls of Niles, Ill. The phase adjusting coupling 124 is used to change the relative angular position of the output presser plate rocker shaft 122 with respect to the input presser plate rocker shaft 120, thereby changing the amplitude of the reciprocating linear motion of the presser plate 82 as well as the location of that reciprocating motion with respect to the needle plate 78. By changing the location of the reciprocating motion, the gap between the presser plate 82 and needle plate 78 is thereby adjustable to permit quilts of different thicknesses to be stitched by the quilting station 30. This adjustment of the coupling 124 may be made by a servo motor 129 operating in response to a signal from the controller 100, or may be made manually, by turning an adjustment ring, for example.

Figure 5:
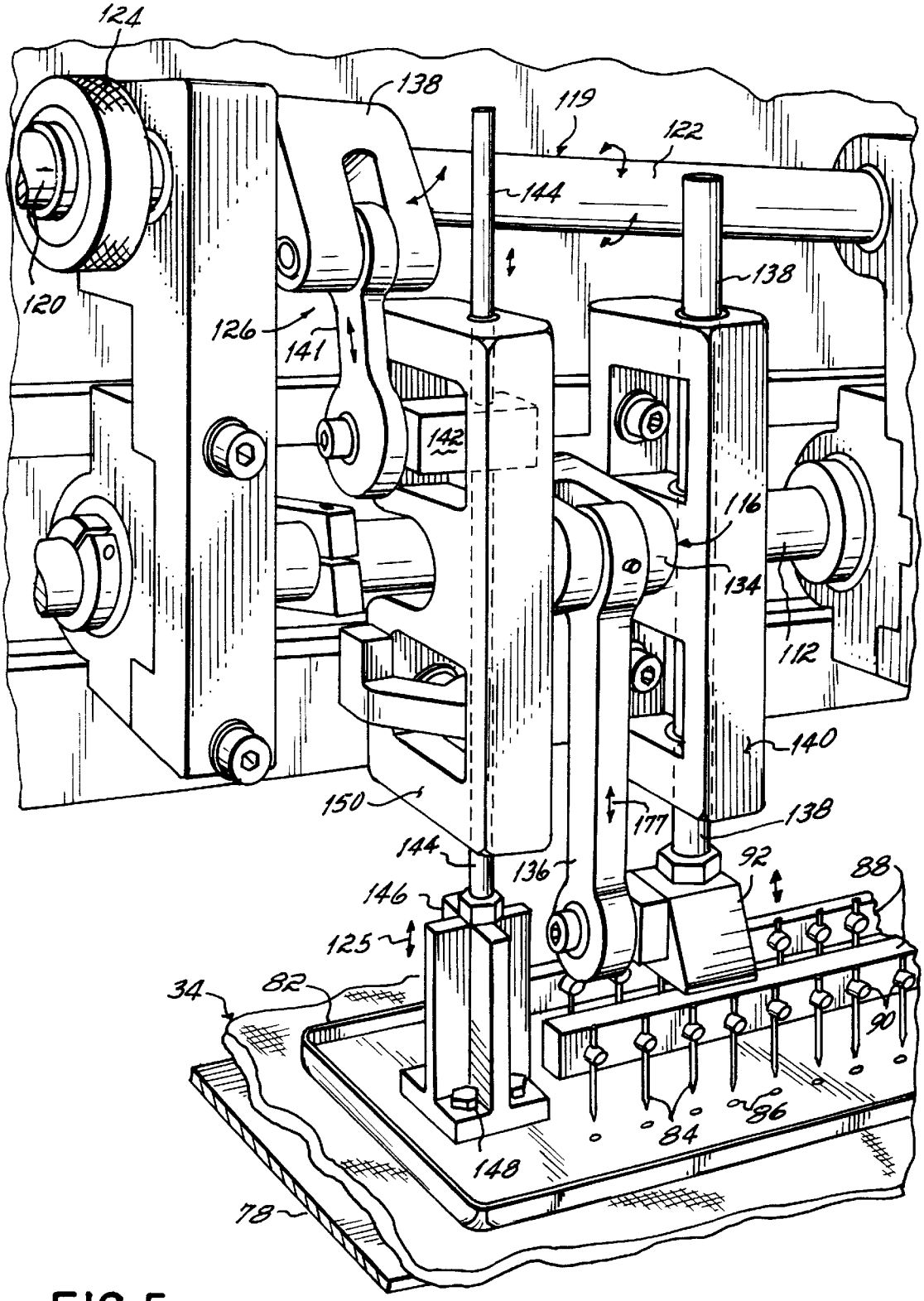
FIG. 5 is a perspective view of one set of the mechanical linkages used to operate the presser plate and needle bars of the embodiment of FIG. 3.

FIGS. 3–5 illustrate further details of the drive mechanisms for the presser plate 82 and needle bars 88. In FIGS. 3–5, many structural details of the quilting station 30 are not illustrated to clarify the operation of the drive mechanism. Further, drive shaft 108 and rocker shafts 112, 119 extend transversely to the direction of feed of the fabric 32 across the full length of the quilting station 30 and are supported by bearings at both ends of the shafts. The linkage 110 connecting the drive shaft 108 to the needle bar rocker shaft 112 is normally located at one end of the shaft 108. One or more mechanical linkage 110 can be used to mechanically couple the shaft 108 to the needle bar rocker shaft 112. For example, identical mechanical linkage 110 can be located at opposite ends of the drive shaft 108. Further, the mechanical linkage 118 interconnecting the needle bar rocker shaft 112 with the presser plate rocker shaft 119 may be located at any point on the drive shaft 108 but normally is located close to one end of the drive shaft 108 and inside of the mechanical linkage 110. Typically, a number of mechanical linkages 116 interconnecting the needle bar rocker shaft 112 to the needle bars 88 are equally spaced over the length of the quilting station 30. Normally, a mechanical linkage 126 interconnecting the presser plate rocker shaft 119 with the presser plate 82 is located over the length of the presser plate rocker shaft 119 adjacent to each of the mechanical linkages 116.

Referring to FIGS. 3 and 4, the main drive shaft 108 includes an eccentric cam 128. The mechanical linkage 110 is comprised of a connecting rod 130 journalled at one end around the main drive shaft 108 and eccentric 128. The connecting rod 130 is pivotally connected at its opposite end to the distal end of a needle bar rocker lever 132. The proximal end of the lever 132 is clamped or otherwise mechanically fixed onto the needle bar rocker shaft 112. Thus, rotation of the drive shaft 108 by motor 106 (FIG. 3) causes the connecting rod to reciprocate in a direction parallel to its longitudinal center line. The linear displacement or amplitude of each reciprocation is a function of the eccentricity of the eccentric cam 128.

The mechanical linkage 118 connecting the needle bar rocker shaft 112 with the input presser plate rocker shaft 120 is comprised of a first driving lever 133 and a connecting link 135 and a driven lever 137. The proximal end of the driving lever 133 is clamped or otherwise mechanically fixed to the needle bar rocker shaft 112. The distal end of the driving lever 133 is pivotally connected to one end of the connecting link 135 and the opposite end of the connecting link 135 is pivotally connected to the distal end of the driven lever 137. The proximal end of the driven lever 137 is clamped or otherwise mechanically fixed to the input presser plate rocker shaft 120.

Referring to FIGS. 3–5, the mechanical linkage 116 connecting the needle bar rocker shaft 112 to the needle bars 88 is comprised of a needle bar drive lever 134 and a needle bar connecting rod 136. The proximal end of the needle bar drive lever 134 is clamped or otherwise mechanically fixed to the needle bar rocker shaft 112, and the distal end of the needle bar drive lever 134 is pivotally connected to an upper end of the needle bar connecting rod 136. The lower end of the needle bar connecting rod is pivotally connected with respect to a cross member 92 that is clamped or otherwise rigidly connected to the needle bars 88. The cross member 92 has a guide rod 158 extending vertically upward through a frame member 140 to ensure that the needle bars 88 reciprocate in a vertical direction. Thus, angular oscillations of the needle bar rocker shaft 112 are converted by mechanical linkage 116 into vertical reciprocating motion of the needle bars 88.

The mechanical linkage 126 connecting the output presser plate rocker shaft 122 to the presser plate 82 is comprised of a presser plate lever 138, a presser plate drive link 141 and a presser plate guide rod 142. The proximal end of the presser plate lever 138 is clamped or otherwise mechanically secured to the output presser plate rocker shaft 122. The distal end of the presser plate lever 138 is pivotally connected to an upper end of the presser plate drive link 141. The presser plate guide rod 142 is mounted within bearings (not shown) that in turn are supported by a frame member 150. The lower end of the presser plate drive link 141 is pivotally connected to a presser plate block 142 that is clamped or otherwise mechanically secured to an upper end of a presser plate guide rod 144. The lower end of the presser plate guide rod terminates into a presser plate mounting block 146 that is secured to the presser plate 82 by fasteners 148 or other means. Thus, oscillations of the needle bar rocker shaft 112 are transmitted via the mechanical linkage 118 to the presser plate rocker shaft 119. Angular oscillations of the presser plate rocker shaft 119 are transferred via mechanical linkage 126 to vertical reciprocations of the presser plate 82.

In use, the quilting machine 20 is illustrated as set up to establish a gap between the presser plate 82 and the needle plate 78 that is suitable to stitch layers of fabric 32 that are relatively thin. In FIG. 6A, the presser plate 82 is located approximately 0.25 inches above the needle plate 78, and a first fabric 32 having a first thickness is loaded into the quilting station 30 and located between the presser plate 82 and the needle plate 78. As the needle bar rocker shaft 112 begins its oscillation in the generally clockwise direction, mechanical linkage 116 shown in FIGS. 3–5 causes the needle 84 to begin traveling vertically downward as previously described. Further, the presser plate rocker shaft 119, being mechanically linked to the needle bar rocker shaft 112 by mechanical linkage 118, also begins to rotate in the clockwise direction. Clockwise rotation of the presser plate rocker shaft moves the presser plate 82 vertically downward to compact the fabric 32. The presser plate 82 and needle 84 continue their downward motion until the needle bar rocker shaft 112 rotates through an angular displacement of approximately 40° to the position illustrated in FIG. 6B. The mechanical linkage 118 causes the presser plate rocker shaft 119 to rotate through an angular displacement of approximately 25° to the position illustrated in FIG. 6B. At that point, the presser plate 82 and needle 84 will be at their lowermost positions providing the smallest gap between the presser plate 82 and the needle plate 78. Thus, the presser plate 82 has moved downward through a stroke of 0.125 inches, thereby causing the presser plate 82 to compact the material 32 to a thickness of approximately 0.125 inches. The needle bar rocker shaft 112 then reverses direction and rotates back through the 40° angular displacement to the position illustrated in FIG. 6A, thereby retracting the needle 84 from the material 32 and rotating the presser plate rocker shaft 119 and lifting the presser plate 82 to their respective original positions. The feed rollers 56, 58 and transverse drive 96 then move the material 32 to an appropriate location for the next stitch as required, for example, by the pattern 64.

Figure 6B:
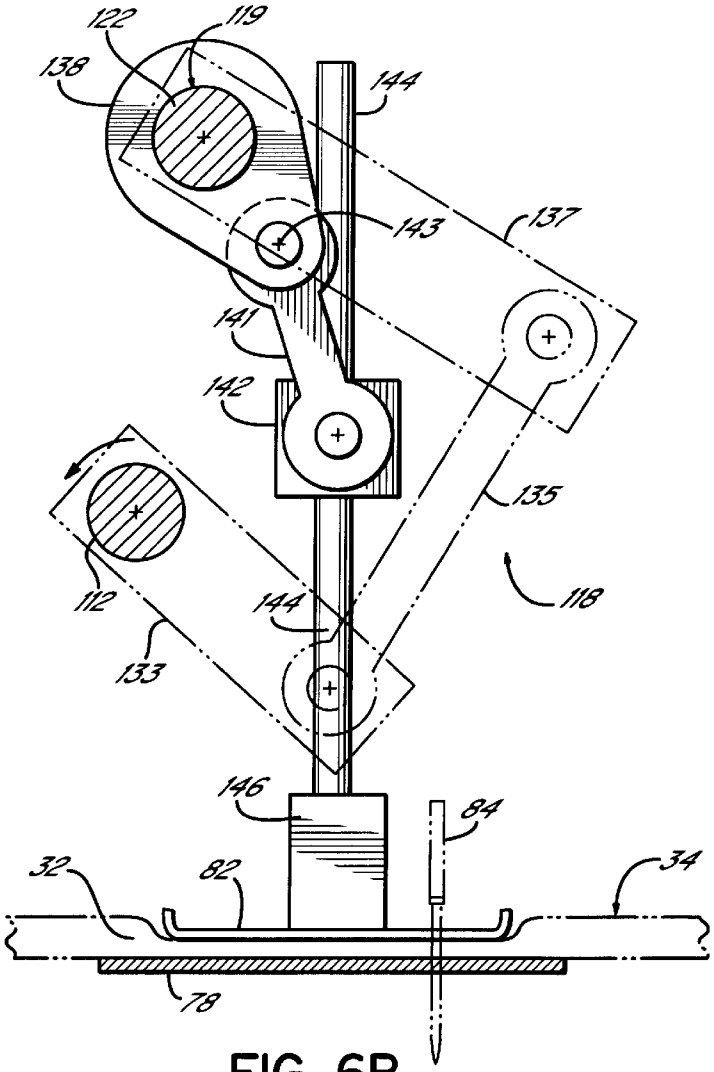
FIGS. 6A and 6B are diagrammatic views illustrating the uppermost and lowermost positions of the presser plate and needle with the presser plate adjusted to stitch fabric having a lesser thickness in accordance with the embodiment of FIG. 3.
Figure 6A:
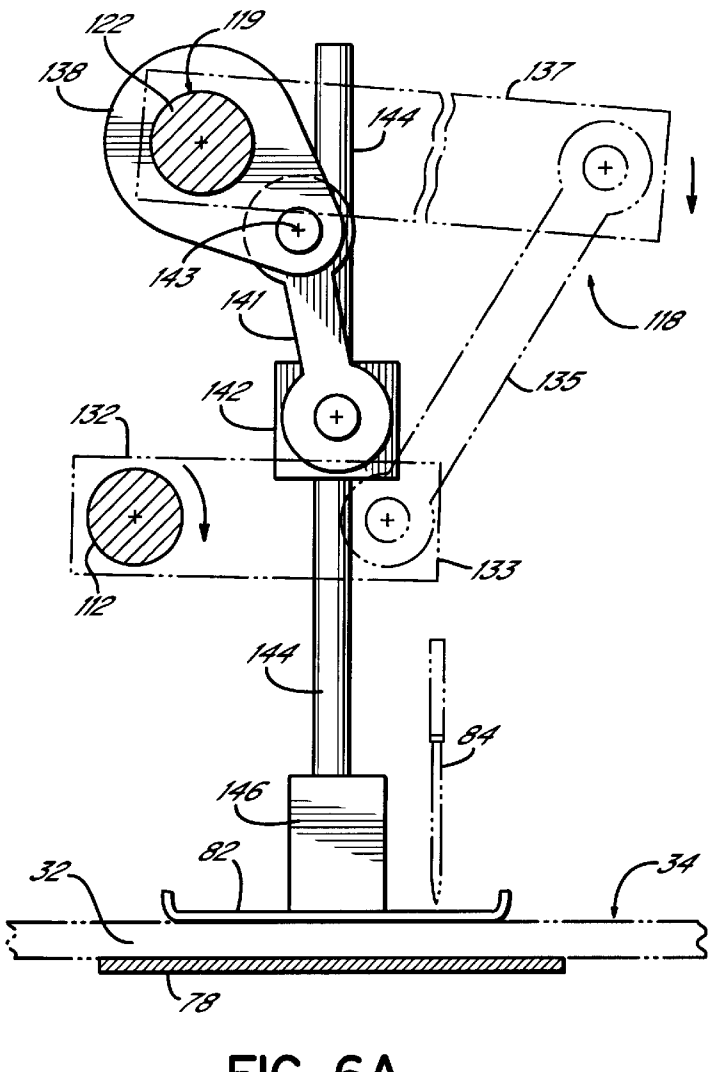

It should be noted that in FIG. 6B, the pivot axes of the presser plate rocker shaft 119, presser plate lever 138 and presser plate drive link 141 form a generally straight line. The toggle formed at the pivot 143 interconnecting the presser plate lever 138 and presser plate drive link 141 functions to provide a dwell time for the presser plate 82 in its lowermost, full compaction position. Preferably, the presser plate rocker shaft 119 rotates several degrees beyond the in-line position to "toggle-over" the pivot 143. The net result is that the presser plate rocker shaft 119 rotates clockwise through a small angle to toggle-over the pivot joint 143, reverses direction and moves in a counterclockwise direction through the same angular displacement without the presser plate 82 experiencing significant vertical motion. Thus, during the time required for the presser plate rocker shaft 22 to move through those angular displacements to toggle-over and retract the pivot 143, the presser plate 82 dwells in a stationary position, thereby maintaining the material 32 in its fully compressed state while the needle 84 is retracting from the material.

Figure 7B:
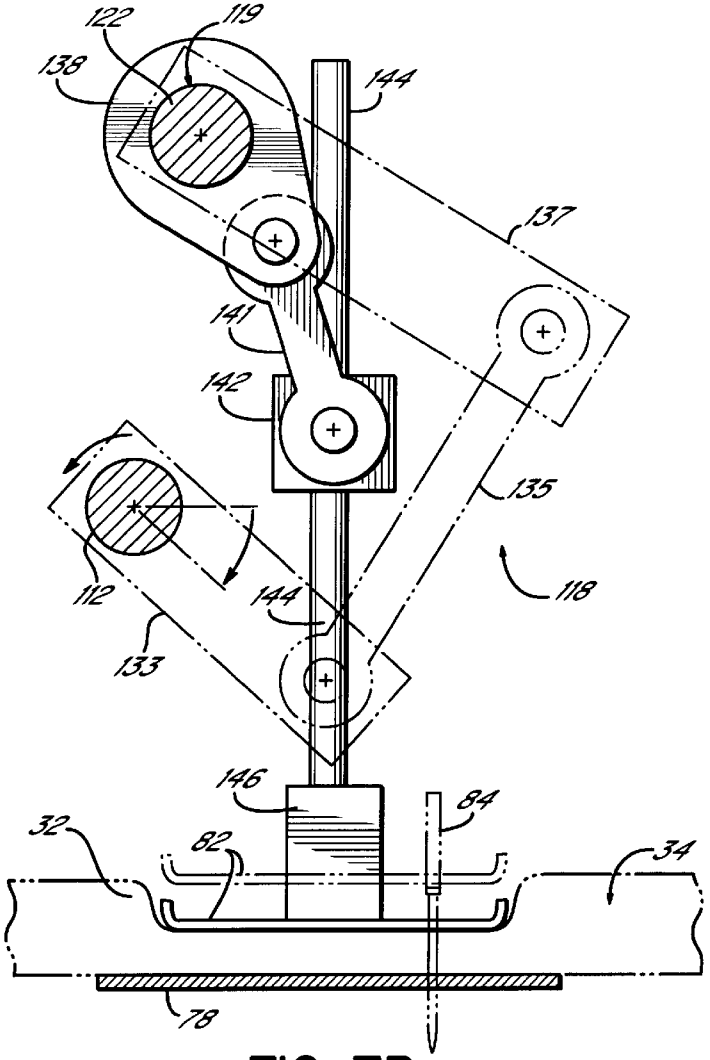
FIGS. 7A and 7B are diagrammatic views illustrating the uppermost and lowermost positions of the presser plate and needle with the presser plate adjusted to stitch fabric having a greater thickness in accordance with the embodiment of FIG. 3.
Figure 7A:
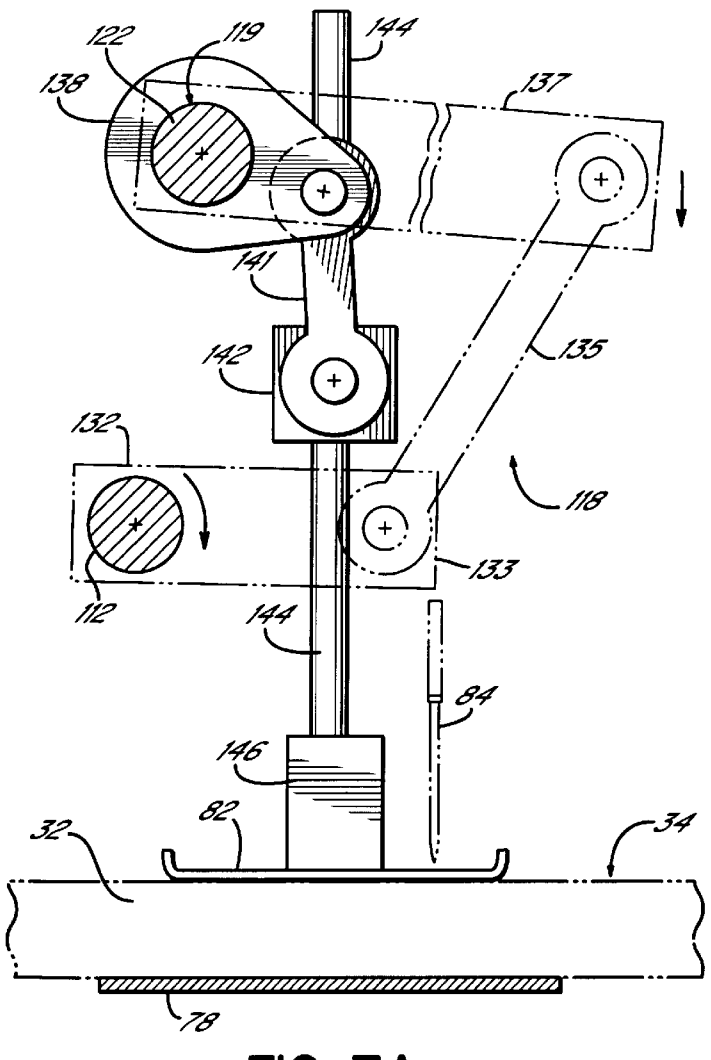

If a thicker quilt is to be stitched, the quilting machine is stopped; and the static phase adjusting coupling 124 is utilized to change the height of the presser plate 82, thereby changing the gap between the presser plate 82 and the needle plate 78. The coupling 124 has an outer ring 131 which is unlocked by activation of a solenoid 139 in response to a signal from controller 100. Then, the ring 131 rotated in a direction causing the presser plate rocker shaft 119 to turn counterclockwise as viewed in FIG. 7A. Thus, by rotating the outer ring of the static phase coupling 124, the input presser plate rocker shaft 120 remains stationary, but the output presser plate rocker shaft 122 will rotate, for example, counterclockwise, as viewed in FIG. 7A. Each revolution of the outer ring of the phase coupling 124 results in a rotation of approximately 3.6° of the outer presser plate rocker shaft 122. If it is desired to provide a gap between the presser plate 82 and needle plate 78 of approximately 0.6275 inches as illustrated in FIG. 7A, the output presser plate rocker shaft 122 will have to be moved approximately 24° in the counterclockwise direction. Thus, the outer ring of the phase adjusting coupling 124 must be moved through approximately 6.7 revolutions. When rotation of the outer collar of phase coupling 124 results in the presser plate 82 having the desired gap or distance from the needle plate 78, the outer ring of the phase coupling 124 is then locked into position, and the stitching cycle may be initiated. In this example, using the coupling 124, the gap between the presser plate 82 and the needle plate 78 is easily increased to approximately 0.6275 inches as illustrated in FIG. 7A.

Thereafter, a second fabric 32 having layers of a second thickness are loaded into the quilting machine 20, and the operation of the quilting machine is started. In this example, a stitching cycle is executed corresponding to that shown in FIGS. 7A, 7B which, except for the size of the gap between the presser plate 82 and the needle plate 78, is substantially the same as the cycle illustrated in FIGS. 6A, 6B. That is, from the highest, fully retracted position of the presser plate 82 and needle 84 illustrated in FIG. 7A to the fully extended, lowermost position of the presser plate 82 and needle 84 illustrated in FIG. 7B, the needle bar rocker shaft 112 rotates through approximately 40°. The mechanical linkage 118 with the presser plate rocker shaft 119 causes the presser plate rocker shaft 119 to rotate clockwise through an angular displacement of approximately 25°. That angular displacement of the presser plate rocker shaft 119 causes the presser plate 82 to move downward through a compression stroke of approximately 0.375 inches to provide full compression with a gap of approximately 0.25 inches between the presser plate 82 and needle plate 78. The needle bar rocker shaft 112 then reverses direction and rotates counterclockwise through an angular displacement of approximately 40° to move the linkages of presser plate 82 and needle 84 to the fully retracted positions illustrated in FIG. 7A.

Thus, the present invention provides a quilting machine and method that is substantially more flexible in its operation. The quilting machine of the present invention permits different gaps between the presser plate 82 and the needle plate 78 to be easily set, so that fabric layers of different thicknesses can be stitched on the same machine. The gap between the presser plate 82 and the needle plate 78 is adjusted simply in seconds by changing the setting of the static phase coupling 124, and it is not necessary to exchange cams or other mechanical components which requires many hours of complex and difficult labor to accomplish. The quilting machine of the present invention provides its user with opportunities to supply different quilted products in a way that was not possible in the past with a single quilting machine.

Additional advantages and modifications to the above embodiment will readily appear to those who are skilled in the art. For example, as illustrated in FIG. 3, a lever arm 132 is utilized to impart angular oscillations to the needle bar rocker shaft 112. Similarly, a second lever arm 1 33 is used to transmit an angular oscillation from the needle bar rocker shaft 112 to the presser plate rocker shaft 119. As will be appreciated, the levers 132 and 133 may be integrated into a single unitary lever that extends from either one side or both sides of the needle bar rocker shaft 112.

Further, the disclosed embodiment in FIG. 3 illustrates the motor 106 directly driving the drive shaft 108. As will be appreciated, the motor 106 and drive shaft 108 may be mechanically coupled with other devices, for example, timing belts, chains, etc., in a known manner. Further, the quilting station 30 illustrated in FIGS. 3–5 provides two needle bars 88. Different numbers of needle bars 88 may be utilized by the quilting station. The use of the static phase coupling 124 to change the relative angular positions of the input and output presser plate rocker shafts 120, 122 may be used with any type and style of quilting machine. Further, the application of the static phase coupling 124 is independent of the relative degree of automation of the quilting machine.

Figure 8:
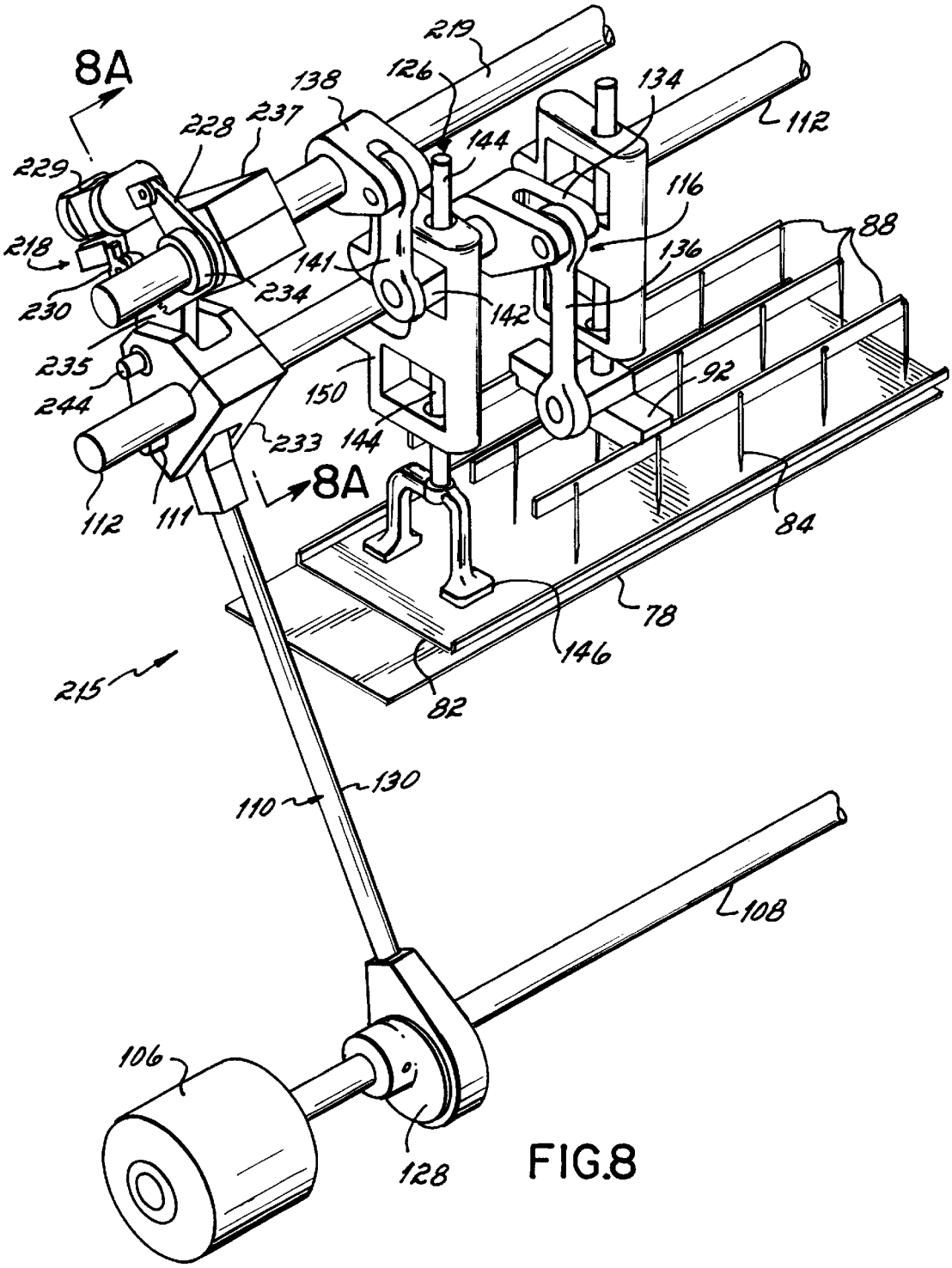
FIG. 8 is a diagrammatic perspective view, similar to FIG. 3, illustrating presser foot adjusting system and related components of alternative embodiments of the invention and the relationship of actuators and drives.
Figure 8A:
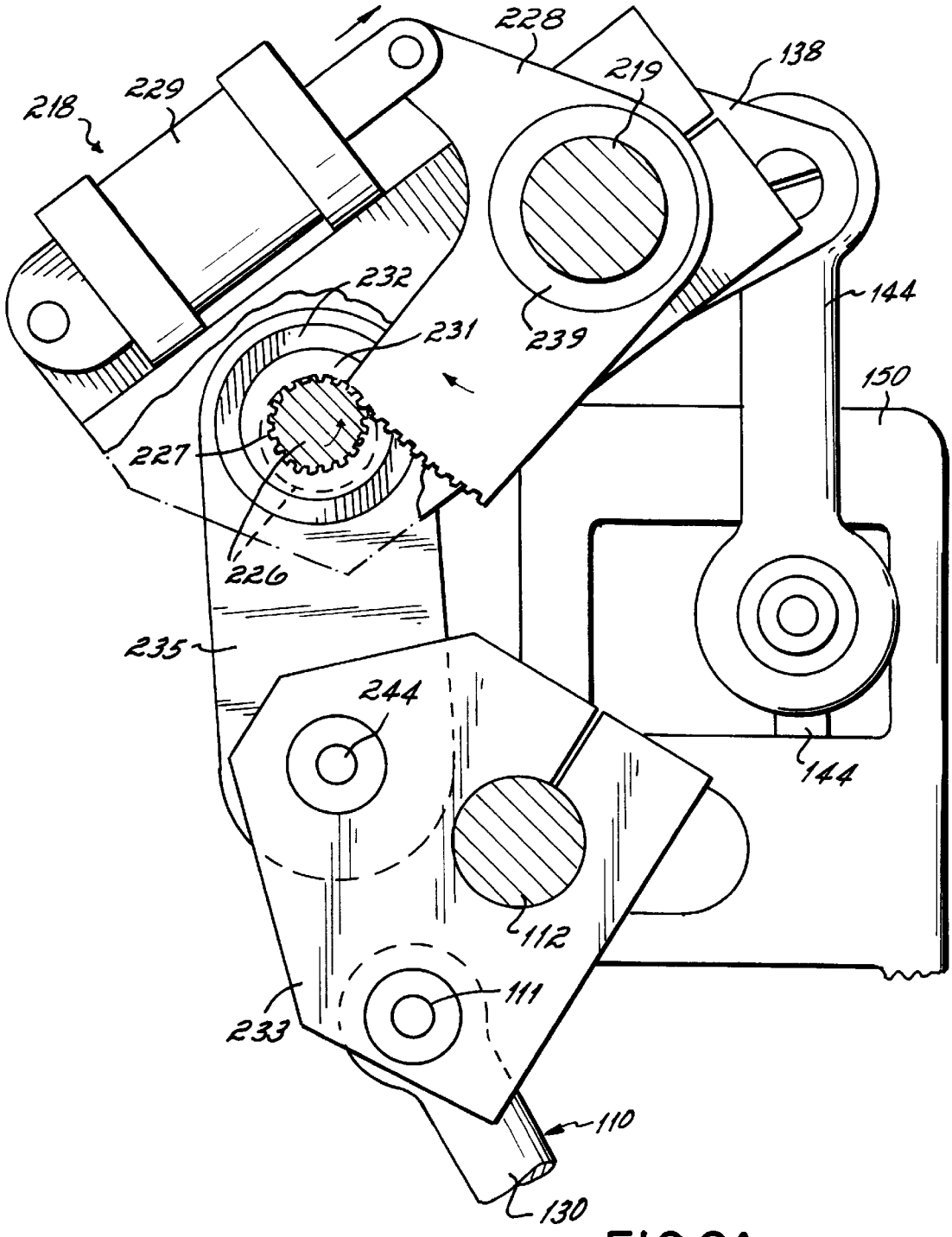
FIG. 8A is a cross-sectional view taken along line 8A—8A of FIG. 8 illustrating the presser plate drive linkage with the presser plate in its raised position and adjusted for minimum presser plate distance from the needle plate.
Figure 8B:
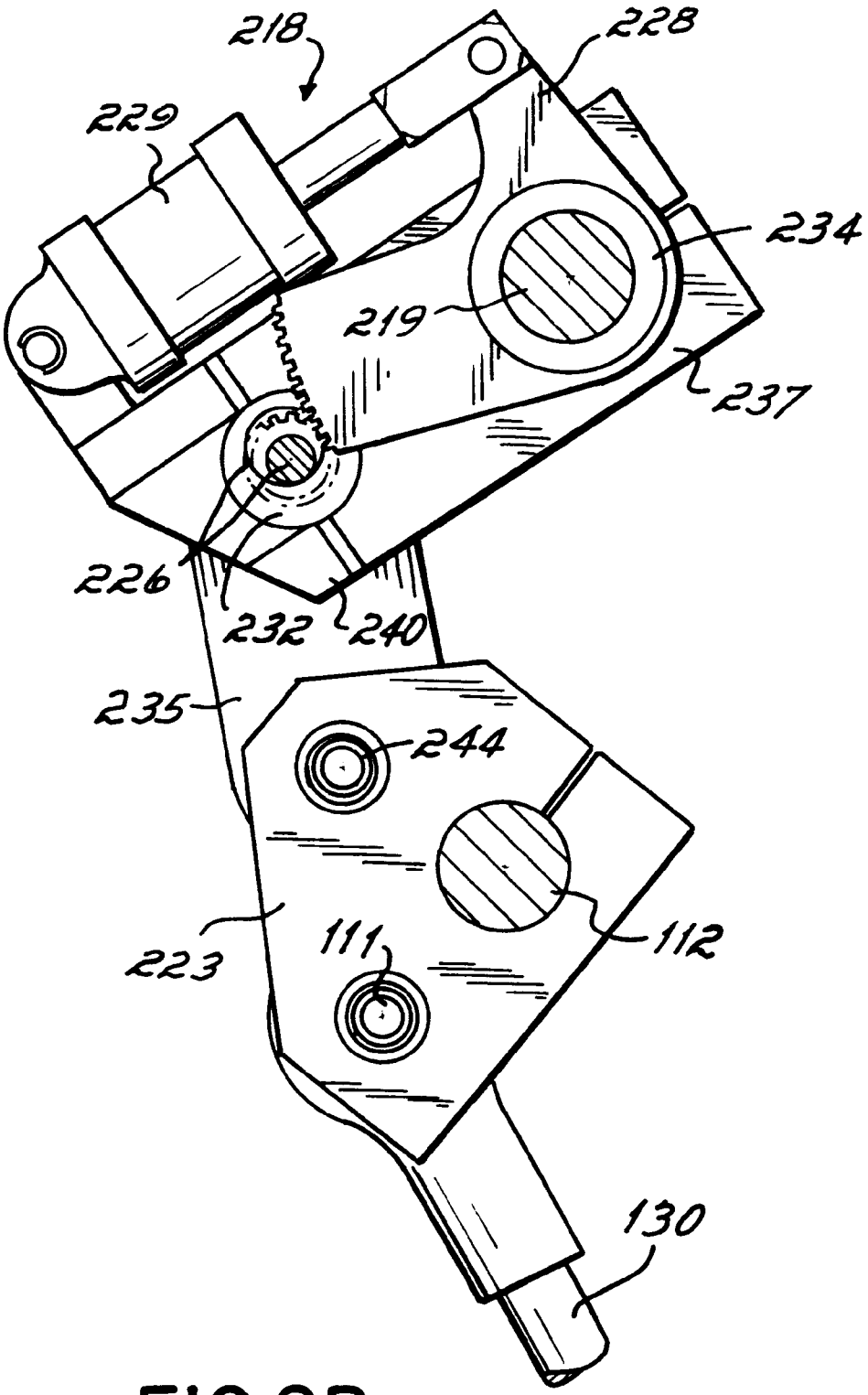
FIG. 8B is a cross-sectional similar to FIG. 8A but with the presser plate adjusted for maximum presser plate distance from the needle plate.
Figure 9:
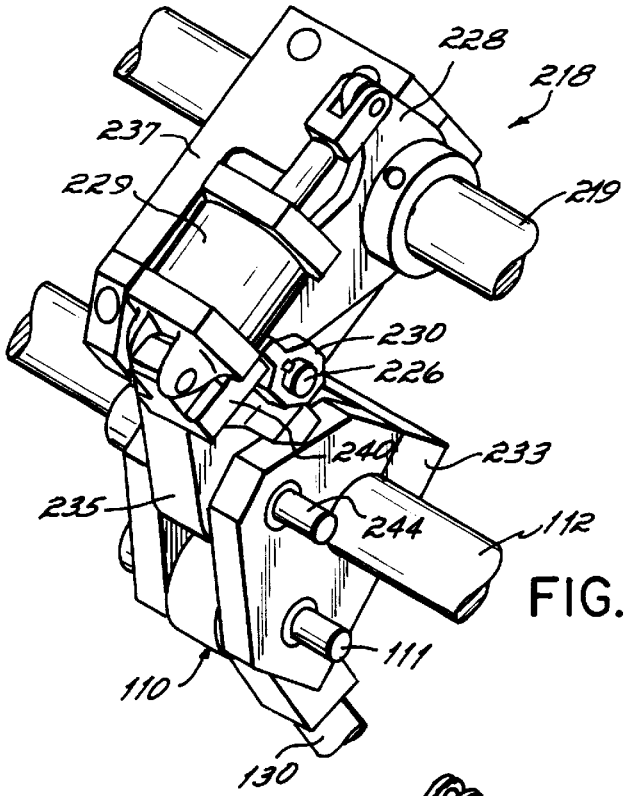
FIG. 9 is a diagrammatic perspective view illustrating the variable linkage of the pressure foot adjusting system of FIG. 8.
Figure 9A:
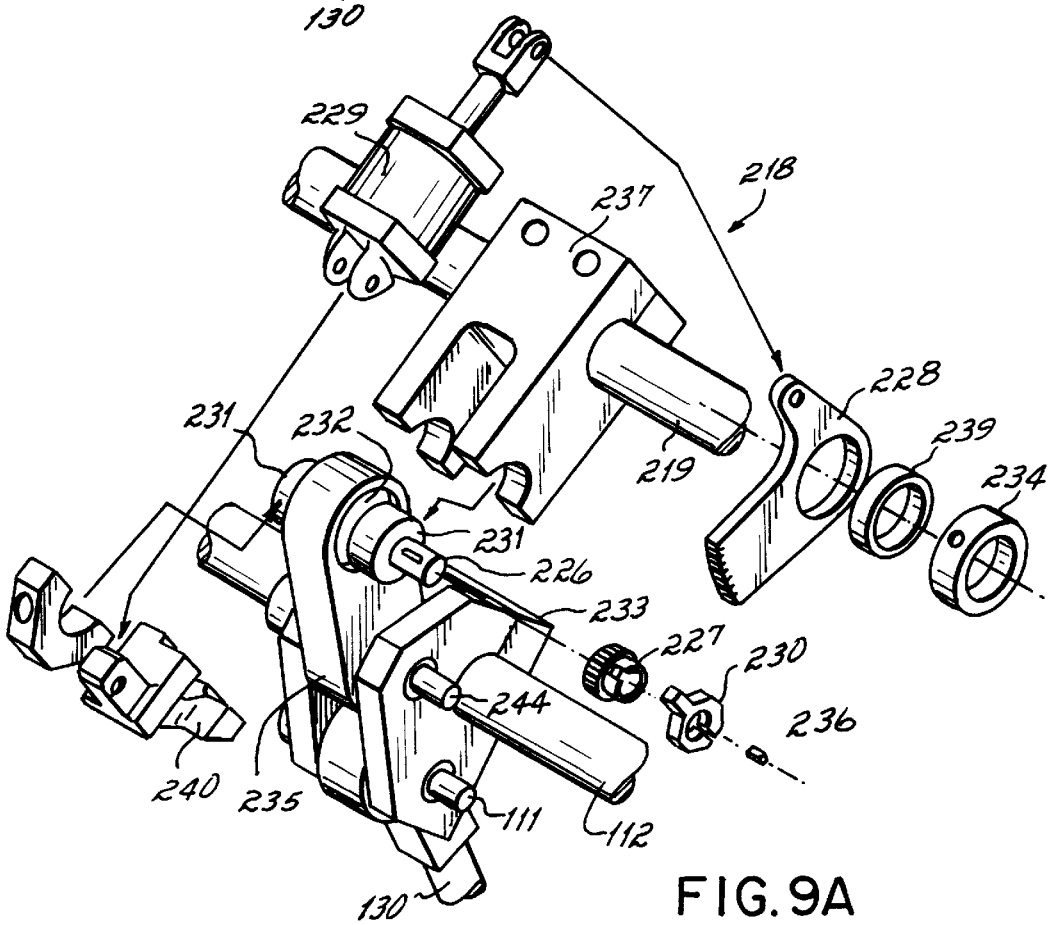
FIG. 9A is a diagrammatic perspective view of the variable linkage of FIG. 9.

Other embodiments are represented by FIGS. 8 through 9A, in which an alternative needle bar and presser plate reciprocating assembly 215 is provided having a variable linkage 218 which replaces the linkage 118 and provides the pressure plate adjustment function provided by the assembly of the split shaft 119 and the static phase adjusting coupling 124 thereof. The variable linkage 218 connects the needle bar rocker shaft 112 with a solid one piece presser plate rocker shaft 219, and includes a first driving lever block assembly 233, a connecting link 235 and a driven lever block assembly 237. The proximal end of the driving lever block assembly 233 is clamped or otherwise rigidly attached fixed to the needle bar rocker shaft 112. The distal end of the driving lever block assembly 233 is pivotally connected to one end of the connecting link 235 and the opposite end of the connecting link 235 is pivotally connected to the distal end of the driven lever block assembly 237. The proximal end of the driven lever 237 is clamped or otherwise rigidly attached to the presser plate rocker shaft 219.

The mechanical linkage 126 connects the presser plate rocker shaft 219 to the presser plate 82 and includes the presser plate lever 138, the presser plate drive link 141 and the presser plate guide rod 142. The proximal end of the presser plate lever 138 is clamped or otherwise mechanically secured to the presser plate rocker shaft 219. The distal end of the presser plate lever 138 is pivotally connected to an upper end of the presser plate drive link 141. The presser plate guide rod 142 is mounted within bearings (not shown) that in turn are supported by a frame member 150. The lower end of the presser plate drive link 141 is pivotally connected to a presser plate block 142 that is clamped or otherwise mechanically secured to an upper end of a presser plate guide rod 144 The lower end of the presser plate guide rod terminates into a presser plate mounting feet 146 that is secured to the presser plate 82 by fasteners or other means. Thus, oscillations of the needle bar rocker shaft 112 are transmitted via the variable linkage 218 to the presser plate rocker shaft 219. Angular oscillations of the presser plate rocker shaft 219 are transferred via mechanical linkage 126 to vertical reciprocations of the presser plate 82.

The variable linkage 218 transmits the oscillating motion of the needle rocker shaft 112 to the presser plate rocker shaft 219 to drive the presser plate 82 between it's lowermost point of travel closest to the needle plate 78, where it compresses the material to its maximum state of compression for sewing a stitch, and its uppermost point of travel farthest from the needle plate 78, where the material is capable of being moved horizontally parallel to the plates and relative to the paths of travel of the needles. The variable linkage 218 is adjusted by effectively varying the length of the linkage 218 to change the lowermost and uppermost points of travel of the presser plate 82. The length of the linkage is varied by moving the axis of pivot between the connecting link 235 and the driven lever block assembly 237 to effectively change the length of the connecting link 235 and the angular adjustment of shaft 219. The axis is the centerline of an eccentric lobe 226, which, when rotated, increases or decreases the distance between the actual pivot points of the link 235 in the block assembly 237. This results in a corresponding change in the presser foot height. The eccentric lobe 226 is mounted with bearings 231, 232 in both the lever block assembly 237 and the link 235, respectively. A mechanism that includes a gear 227 on one end of the shaft of the eccentric lobe 226 and a geared lever 228 mechanism pivotally mounted on the block assembly 237 rotates the eccentric lobe 226. The geared lever 228 rotates on bearing 239 about the presser foot rocker shaft 219 and is held in place with a collar 234. A linear motor or actuator 229, described here as a two position bidirectional pneumatic cylinder, is mounted on the block assembly 237 and actuates the mechanism of gear 227 and lever 228, forcing a stop lever 230 against a mechanical stop 235 at either end of the rotary travel of the eccentric lobe 226. The gear 227 and stop lever 230 are keyed to the eccentric shaft 226 with a key 236. A pneumatic control valve (not shown) actuates the cylinder. The machine controller 100 operates the pneumatic control valve and thereby toggles the pressure foot setting between a higher and lower setting.

The mechanical parts can be divided into two categories. One category is includes the force transmitting parts, which are the lever block 233, the link 235, the eccentric lobe 226, the bearings 231 and 232 and the lever block 237, which transmit the heavy forces that are required to be transmitted from the rocker shaft 112 to the presser foot rocker shaft 219. The other category includes the position holding parts and parts that provide the adjustability are pneumatic cylinder 229, gear lever 228, bearing 239, lock ring 234, gear 227, stop lever 230, stop 240 and key pin 236, which hold the force transmitting parts in their proper positions, but do not transmit the heavy forces themselves.

The actuator or motor 229 can be in the form of a double acting two position pneumatic cylinder, solenoid or other double acting motor, or it may be in the form of a multiple position motor that can adjust the linkage among a plurality of discrete positions or infinitely over a range. For example, greater adjustability than is provided by a single double acting actuator can be achieved by adding a second eccentric system into the linkage 218 in series with the first eccentric lobe element 226, for example by adding a similar lobe in place of pivot shaft 444 on the other end of the link 235. An additional double acting actuator 229 would be provided to switch this lobe between two positions, thereby producing a total of four adjustments or presser foot positions rather than two, depending on which actuator 229 were actuated: one, the other, neither, or both. Infinite adjustability could be provided by using, instead of a two position cylinder for the actuator 229, using a multiple position actuator to rotate the eccentric to more than only two positions. This can be achieved by incorporating a motor such as a stepping motor or other device capable of stopping and holding the eccentric in either a plurality of discrete positions or an infinite number of positions within its range of travel.

The actuator may be controlled to adjust the presser foot height in several ways.

Preferably, several modes of control are provided, including a manual mode, which gives an operator the flexibility to set or change the presser foot height, a batch mode, in which the controller signals the actuator to make set the height that has been predetermined to be appropriate for the product being quilted, and an automatic mode in which sensors measure one or more parameters during the quilting operation to determine the height setting appropriate for the material being quilted. In each mode, the controller 100 sends a signal to the actuator 229 to execute the adjustment. Similar control modes can be used for the actuator 129 in the embodiment of FIGS. 3–7B discussed above.

In the manual mode, a touchscreen icon for selecting manual operation of the presser foot setting is incorporated into the operator interface of the controller 100. When the icon is selected, screen controls are presented to the operator by which a presser foot setting or setting change can be entered to the controller 100. The manual setting is preferably made when the machine is stopped for adjustment so that the high forces present during high speed quilting are not encountered during adjustment. Automated setting can be synchronized to those points in the quilting machine cycle when the adjustments can be made.

In the batch mode operation, information regarding proper presser foot height is included in a product database that includes data for all of the automatic parameter settings to produce each product scheduled on the quilting machine. Adjustments are made automatically by the controller 100 at the correct time in the quilting process as the materials are in transition under the presser foot. More detailed explanations of batch mode control are set forth in For "batch mode" U.S. Pat. No. 5,544,599 and U.S. patent application Ser. No.

09/301,653, filed Apr. 28, 1999 by Frazer et al. entitled Quilt Making Automatic Scheduling System and Method, both hereby expressly incorporated by reference herein.

In automatic mode, automatic adjustments are made based on real time sensing of one or more variables such as the thickness of the material or the density of the material. This sensing can be made by gages or other thickness or density sensing devices (for example thickness gage 260 as illustrated in FIG. 3) to measure these quantities directly, but is most easily accomplished by electronically monitoring machine parameters directly affected by those variables, such as the load and consequential increased torque demands being placed on the machine (for example, through feedback 261 from the drive motor 106 to the controller 100 as illustrated in FIG. 3), or by physical load measuring devices.

The invention is not limited to the specific details shown and described herein. Departures may be made from the details described herein without departing from the spirit and scope of the claims which follow.

What is claimed is:

1. A quilting apparatus comprising:

a needle plate for supporting a fabric to be quilted;

a presser plate parallel to the needle plate and moveably mounted to reciprocate during each of a plurality of stitching cycles, between a material clamping position spaced from and relatively proximate to the needle plate and a material releasing position spaced from and relatively remote from the needle plate;

a ganged needle array located opposite the presser plate from the needle plate having thereon a plurality of needles each positioned to pass through aligned arrays of holes in the pressure plate and needle plate to stitch material clamped between the needle plate and the pressure plate when the pressure plate is in its clamping position;

a needle rocker shaft linked to the needle array and mounted to oscillate through angular displacements to impart reciprocating motion to the needles of the array;

a presser plate rocker shaft linked to the presser plate and mounted to oscillate through angular displacements to impart reciprocating motion to the presser plate in response to the angular displacements of the needle rocker shaft;

a drive motor having an output connected to the needle rocker shaft to drive the needles of the array in their reciprocating motion and to thereby drive the presser plate in its reciprocating motion;

an adjustable element connected in series with the presser plate rocker shaft between the needle rocker shaft and the presser plate whereby the range of the reciprocating motion of the presser plate can be adjusted;

an adjustment motor having an output connected to the adjustable element; and a controller having a control signal output connected to the adjustment motor to control the motor to move the adjustable element to thereby adjust the range of the reciprocating motion of the presser plate.

2. A quilting apparatus comprising:

a needle plate for supporting a fabric to be quilted;

a presser plate parallel to the needle plate and moveably mounted to reciprocate, during each of a plurality of stitching cycles of the apparatus, between a material clamping position spaced from and relatively proximate to the needle plate and a material releasing position spaced from and relatively remote from the needle plate;

a drive motor for driving the apparatus through the plurality of cycles;

a presser plate drive linkage connecting the presser plate to an output of the drive motor; the linkage having a variable element therein moveable to and from each of a plurality of settings to thereby vary the spacing between the needle plate and the presser plate when in its material clamping position;

an actuator having an output connected to the variable element and operable in response to a control signal to selectively move the element to and from each of the settings; and a controller operable to send the control signal to the actuator to change a presser plate setting.

3. The quilting apparatus of claim 2 further comprising:

a sensor responsive to the thickness or density of the fabric; and the controller having an input connected to the sensor and being programmed to automatically determine a pressure plate setting appropriate for quilting the fabric and being operable to send the control signal to the actuator to change the pressure plate setting to the determined setting.

4. The quilting apparatus of claim 2 wherein:

the controller has a memory associated therewith having stored therein data of machine parameters for the quilting of a plurality of different quilted fabrics, the data including the presser plate setting appropriate for quilting each respective product; and the controller is operable in response to the data stored in the memory to control parameters of the apparatus to produce each of the different quilted products, including to generate the control signal to the actuator to cause the actuator to effect the pressure plate settings appropriate to respectively quilt each of the products.

5. The quilting apparatus of claim 2 wherein:

the controller has an input associated therewith for receiving a presser plate setting command from an operator; and the controller is operable in response to a presser plate setting command from received on the input from the operator to generate the control signal to the actuator to cause the actuator to set the pressure plate spacing in accordance with the received command.

6. The quilting apparatus of claim 2 wherein:

the presser plate drive linkage includes a presser plate rocker shaft having an input link connected thereto and driven by the motor and an output link connected to the presser plate;

the presser plate rocker shaft having a coupling therein that is adjustable to vary the phase angle between the input link and the output link to thereby vary the presser plate setting; and the actuator is operably connected to the coupling to vary the coupling in response to the control signal.

7. The quilting apparatus of claim 2 wherein:

the presser plate drive linkage includes a presser plate rocker shaft having an input link connected thereto and driven by the motor and an output link connected to the presser plate;

the input link has a variable element therein that is adjustable to vary the range of oscillation of the presser plate rocker shaft to thereby vary the presser plate setting; and the actuator is operably connected to the variable element to vary the coupling in response to the control signal.

8. The quilting apparatus of claim 7 wherein:

the apparatus includes a needle rocker shaft having an input connected to and driven by the motor; and the input link of the presser plate rocker shaft is connected to and driven by the needle rocker shaft.

9. The quilting apparatus of claim 7 wherein:

the actuator includes a two position double acting actuator operable to selectively move the variable element between two settings to effect either of two material clamping positions having different spacing between the presser plate and the needle plate.

10. The quilting apparatus of claim 7 wherein:

the actuator includes a plurality of two position double acting cylinders each operable to selectively move the variable element between two settings and both in combination operable to move the variable element among a plurality of more than two positions to effect a plurality of more than two material clamping positions having different spacing between the presser plate and the needle plate.

11. The quilting apparatus of claim 7 wherein:

the actuator includes a linear actuator having more than two discrete positions and operable to selectively move the variable element among the more than two positions to effect a plurality of more than two material clamping positions having different spacing between the presser plate and the needle plate.

12. The quilting apparatus of claim 7 wherein:

the actuator includes an actuator that is variable continuously over a range of positions and operable to selectively move the variable element to any of a plurality of positions within the range to effect an infinite plurality of material clamping positions having different spacing between the presser plate and the needle plate.

13. The quilting apparatus of claim 7 wherein:

the presser plate drive linkage is configured to transmit driving force through a series of drive members extending from the motor to the presser plate; and the actuator is located outside of the series of drive members so that the driving force bypasses the actuator.

14. A quilting method comprising:

setting a presser plate to a first position spaced from a needle plate;

loading a first fabric of a first thickness into the quilting machine;

reciprocating a needle holder relative to the first fabric while reciprocating the presser plate to and from the first position to cause a synchronized operation of the needle and the presser plate, thereby quilting the first fabric; then loading a second fabric of a second thickness into the quilting machine and generating a control signal to drive an adjustment motor to set the presser plate to a second position spaced from the needle plate; and reciprocating a needle holder relative to the second fabric while reciprocating the presser plate to and from the second position to cause a synchronized operation of the needle and the presser plate, thereby quilting the second fabric.

* * * * *

UNITED STATES PATENT AND TRADEMARK OFFICE

CERTIFICATE OF CORRECTION

PATENT NO. : 6,170,414 B1
DATED : January 9, 2001
INVENTOR(S) : Kaetterhenry et al.

It is certified that error appears in the above-identified patent and that said Letters Patent is hereby corrected as shown below:

Column 3,
Line 34, after "torques", insert -- , --.
Line 36, after "function", insert -- of --.

Column 4,
Line 11, delete "positions" and insert therefor -- position --.

Column 5,
Line 65, after "cross-sectional", insert -- view --.

Column 7,
Line 15, delete "correspond", and insert therefor -- corresponds --.
Lines 39 and 42 delete "patterns 64", and insert therefor -- pattern 64 --.
Line 47, delete "by the a feed roller", and insert therefor -- by a feed roller --.
Line 65, after "98", insert -- , --.

Column 8,
Line 16, delete "operate", and insert therefor -- operates --.

Column 9,
Lines 28, and 30 delete "linkage", and insert therefor -- linkages --.
Line 46, after "eccentric," and insert -- cam --.

Column 11,
Line 36, after "131" insert -- is --.

Column 12,
Line 59, delete "pressure", and insert therefor -- presser --.

Column 13,
Line 20, after "144", insert -- . --.
Line 30, delete "it's", and insert therefor -- its --.
Line 64, delete "pressure", and insert therefor -- presser --.
Line 67, after "category", delete -- is --.

Column 14,
Line 66, after "in", delete -- For --.

UNITED STATES PATENT AND TRADEMARK OFFICE

CERTIFICATE OF CORRECTION

PATENT NO. : 6,170,414 B1
DATED : January 9, 2001
INVENTOR(S) : Kaetterhenry et al.

It is certified that error appears in the above-identified patent and that said Letters Patent is hereby corrected as shown below:

Column 15, claim 1,
Line 24, after "reciprocate", insert -- , --, as shown on page 28, line 3 of the application as filed.
Lines 32 and 34 delete "pressure", and insert therefor -- presser --.

Column 16, claim 3,
Lines 19 and 22 delete "pressure", and insert therefor -- presser --.

Column 16, claim 4,
Line 34, delete "pressure", and insert therefor -- presser --.

Column 16, claim 5,
Line 41, after "command", delete -- from --, as shown in the Examiner's Amendment dated July 12, 2000 on page 2, paragraph 5.
Line 43, delete "pressure", and insert therefor -- presser --.

Signed and Sealed this

Fifteenth Day of January, 2002

*Attest:*

*Attesting Officer*

JAMES E. ROGAN
*Director of the United States Patent and Trademark Office*